US007677004B2

(12) United States Patent
LaLonde

(10) Patent No.: US 7,677,004 B2
(45) Date of Patent: Mar. 16, 2010

(54) CONFORMABLE WIDE WALL ANGLE

(75) Inventor: Paul D. LaLonde, Highland Park, IL (US)

(73) Assignee: USG Interiors, Inc., Chicago, IL (US)

( * ) Notice: Subject to any disclaimer, the term of this patent is extended or adjusted under 35 U.S.C. 154(b) by 19 days.

(21) Appl. No.: 11/946,936

(22) Filed: Nov. 29, 2007

(65) Prior Publication Data

US 2009/0139158 A1 Jun. 4, 2009

(51) Int. Cl.
*E04B 5/00* (2006.01)

(52) U.S. Cl. ..... 52/506.06; 52/243.1; 52/506.07; 52/506.1; 52/733.1; 52/518; 52/545

(58) Field of Classification Search ..... 52/506.06, 52/506.07, 506.08, 506.09, 506.1, 733.1, 52/518, 523, 524, 536, 519, 528, 531, 545
See application file for complete search history.

(56) References Cited

U.S. PATENT DOCUMENTS

| | | | | | |
|---|---|---|---|---|---|
| 3,248,839 | A | | 5/1966 | Roberts et al. | |
| 3,520,099 | A | * | 7/1970 | Mattes | 52/531 |
| 3,649,741 | A | | 3/1972 | Fremont | |
| 4,012,023 | A | | 3/1977 | Melanson | |
| 4,115,970 | A | | 9/1978 | Weinar | |
| 4,399,643 | A | * | 8/1983 | Hafner | 52/530 |
| 4,424,655 | A | * | 1/1984 | Trostle | 52/520 |
| 4,512,127 | A | | 4/1985 | Attaway | |
| 4,549,375 | A | | 10/1985 | Nassof | |
| 4,599,831 | A | * | 7/1986 | Magaha, Jr. | 52/98 |
| 4,991,373 | A | | 2/1991 | Shaub | |
| 5,040,345 | A | * | 8/1991 | Gilmour | 52/243.1 |

(Continued)

FOREIGN PATENT DOCUMENTS

AU 661920 B2 3/1994

(Continued)

OTHER PUBLICATIONS

International Search Report Published as WO 2009/073266 A1, date of Publication Jun. 11, 2009 (PCT/US2008/077787).

*Primary Examiner*—Richard E Chilcot, Jr.
*Assistant Examiner*—Alp Akbasli
(74) *Attorney, Agent, or Firm*—Pearne & Gordon LLP

(57) ABSTRACT

A wide wall angle useful in locations of seismic activity to support ceiling tile and grid tees of a suspended ceiling comprising an assembly of an elongated base angle and an elongated extension strip, the base angle having generally perpendicular legs integral with one another and intersecting at a longitudinally extending corner, one leg being adapted to be fixed against a wall with the corner down, and the other adapted to project horizontally from the wall, the extension strip having a face with greater than the width of the horizontal leg, the extension strip having a multiple layer construction, two layers of the extension strip being held together in close parallel relation by an intermediate web integral with the layers, at least portions of the two layers being arranged to frictionally engage at least a part of the horizontal leg of the base angle spaced from the corner such that the strip can be assembled on and frictionally retained on the horizontal leg of the base angle, the horizontal leg of the base angle being disposed between the two layers of the extension strip.

10 Claims, 2 Drawing Sheets

U.S. PATENT DOCUMENTS

| | | | | |
|---|---|---|---|---|
| 5,058,340 | A | 10/1991 | Muller | |
| 5,157,884 | A | 10/1992 | Schwartz | |
| 5,253,462 | A | 10/1993 | Blitzer et al. | |
| 5,319,907 | A | 6/1994 | Nicholas et al. | |
| 5,651,227 | A * | 7/1997 | Anderson | 52/520 |
| 5,791,093 | A | 8/1998 | Diamond | |
| 6,128,866 | A * | 10/2000 | Wearne | 52/105 |
| 6,170,214 | B1 * | 1/2001 | Treister et al. | 52/511 |
| 6,213,679 | B1 * | 4/2001 | Frobosilo et al. | 403/403 |
| D521,656 | S | 5/2006 | Terrels | |
| 7,137,227 | B2 * | 11/2006 | Franz | 52/243.1 |
| 7,143,562 | B2 | 12/2006 | Krantz-Lilienthal et al. | |
| 7,322,157 | B2 * | 1/2008 | Hang | 52/506.08 |
| 2003/0131552 | A1 * | 7/2003 | Leichtfried | 52/543 |
| 2005/0066604 | A1 * | 3/2005 | Kinzler | 52/506.06 |
| 2005/0072091 | A1 * | 4/2005 | Morris | 52/518 |
| 2005/0160696 | A1 * | 7/2005 | Kelly et al. | 52/712 |
| 2006/0005493 | A1 | 1/2006 | Burns et al. | |
| 2006/0010812 | A1 | 1/2006 | Jones et al. | |
| 2007/0022690 | A1 * | 2/2007 | LaLonde | 52/506.07 |
| 2007/0180787 | A1 | 8/2007 | Fecska | |

FOREIGN PATENT DOCUMENTS

| | | | |
|---|---|---|---|
| EP | 0 795 657 | A2 | 9/1997 |
| KR | 10-2000-0000078 | A | 1/2000 |

* cited by examiner

CONFORMABLE WIDE WALL ANGLE

BACKGROUND OF THE INVENTION

The invention relates to accessories for suspended ceilings and, in particular, to a novel wall angle especially suited for use in locations of potential seismic activity.

PRIOR ART

In conventional suspended ceiling installations, wall angle is typically used along the walls to support the edges of ceiling tiles and ends of cross tees. In cases of expected seismic activity, the wall angle can be specified to be significantly wider than the normal width so that the risk of the ceiling tiles or grid elements slipping off during an earthquake of limited magnitude is reduced. Conventional wide faced wall angle frequently presents a problem because walls are seldom flat. Walls regularly deviate from an ideal flat plane for various reasons. A common reason for a wall to depart from a flat plane is the presence of taped joints in drywall type construction particularly where the joints are between non-tapered panel edges. Such joints can be almost imperceptible to the untrained eye. However, when a conventional wide faced wall angle is installed over a non-flat joint or other irregularity, the visible face of the angle distorts by buckling up or down out of a horizontal plane. This distortion is often unacceptable from an appearance standpoint. Moreover, there appears to be no simple, readily available remedy to conceal or eliminate this buckling action that occurs with conventional seismic wall angle.

SUMMARY OF THE INVENTION

The invention provides a wide faced wall angle suitable for use in locations of seismic activity that effectively eliminates or reduces the distortion of the wide face when the angle is installed on uneven or non-planar areas existing in a wall. The invention reduces the degree of buckling to an acceptable level by creating a two-part wide face. The resulting structure can conform to a non-planar wall area without requiring the part of the wide face distal from the wall to stretch or compress to the degree that would otherwise be required.

In the preferred embodiment, the wall angle assembly utilizes a base angle of conventional equal leg proportions and a leg extending strip that telescopes with the horizontal leg of the base. The illustrated base angle has single layer equal length legs while the extension strip is a multi-layer construction that wraps over and frictionally clasps the horizontal base angle leg. This arrangement greatly reduces the strain necessarily imposed on the horizontal face of the unit and effectively isolates this strain from the extension strip. That is, the extension strip is free of the strain imposed on the base angle when the latter is bent to conform to a non-planar wall surface. Further, the extension strip is the most visible part of the wall angle and is in a location to conceal all or a portion of distortions created in the horizontal leg of the base angle. In the disclosed embodiment, the base angle and the extension strip have hemmed edges that cooperate to resist accidental separation as well as distortion from their ideal straight lines.

DESCRIPTION OF THE PREFERRED EMBODIMENT

Figure 1:
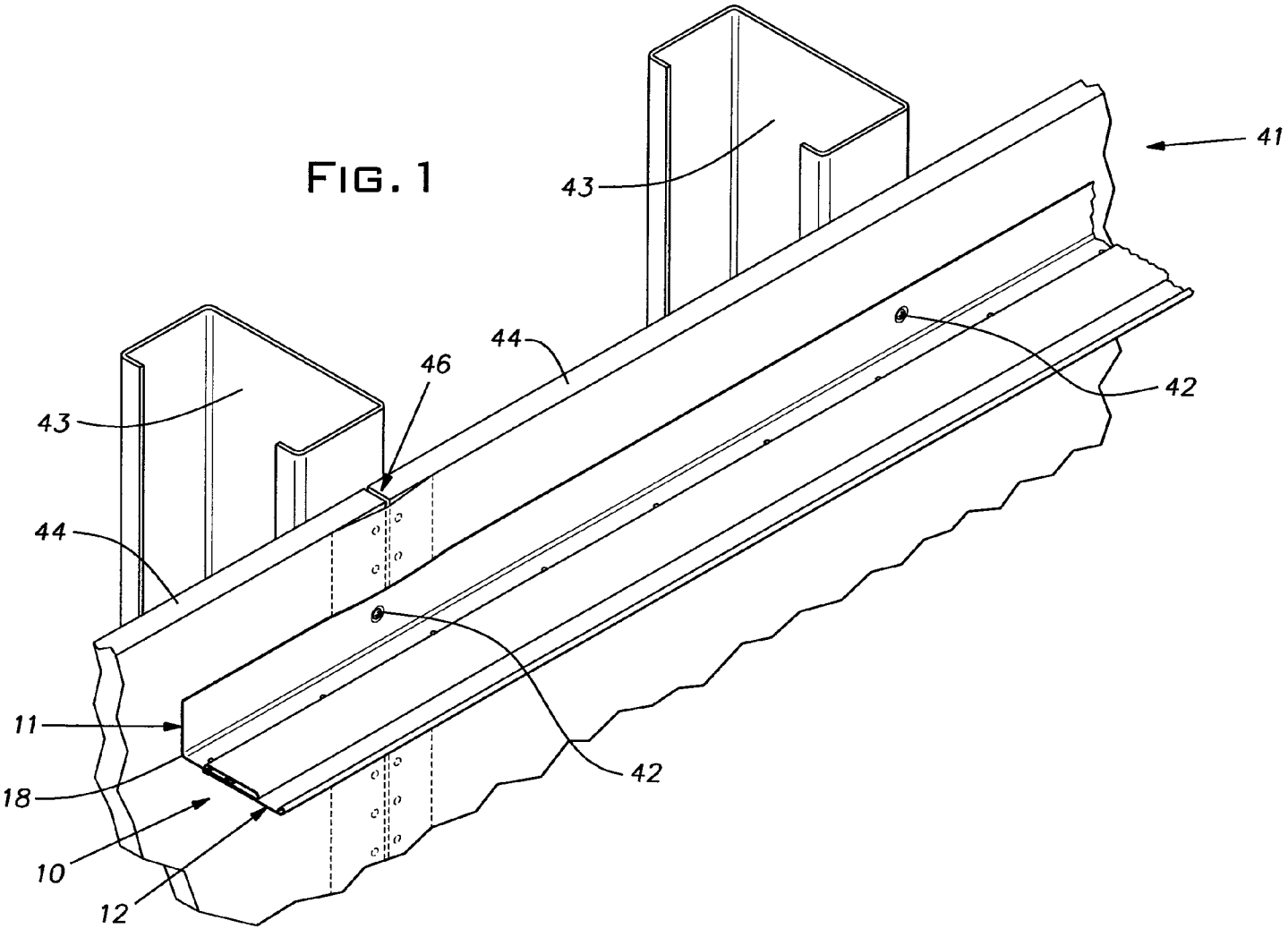
FIG. 1 is an isometric fragmentary view of a wall on which a wall angle of the invention is mounted.
Figure 2:
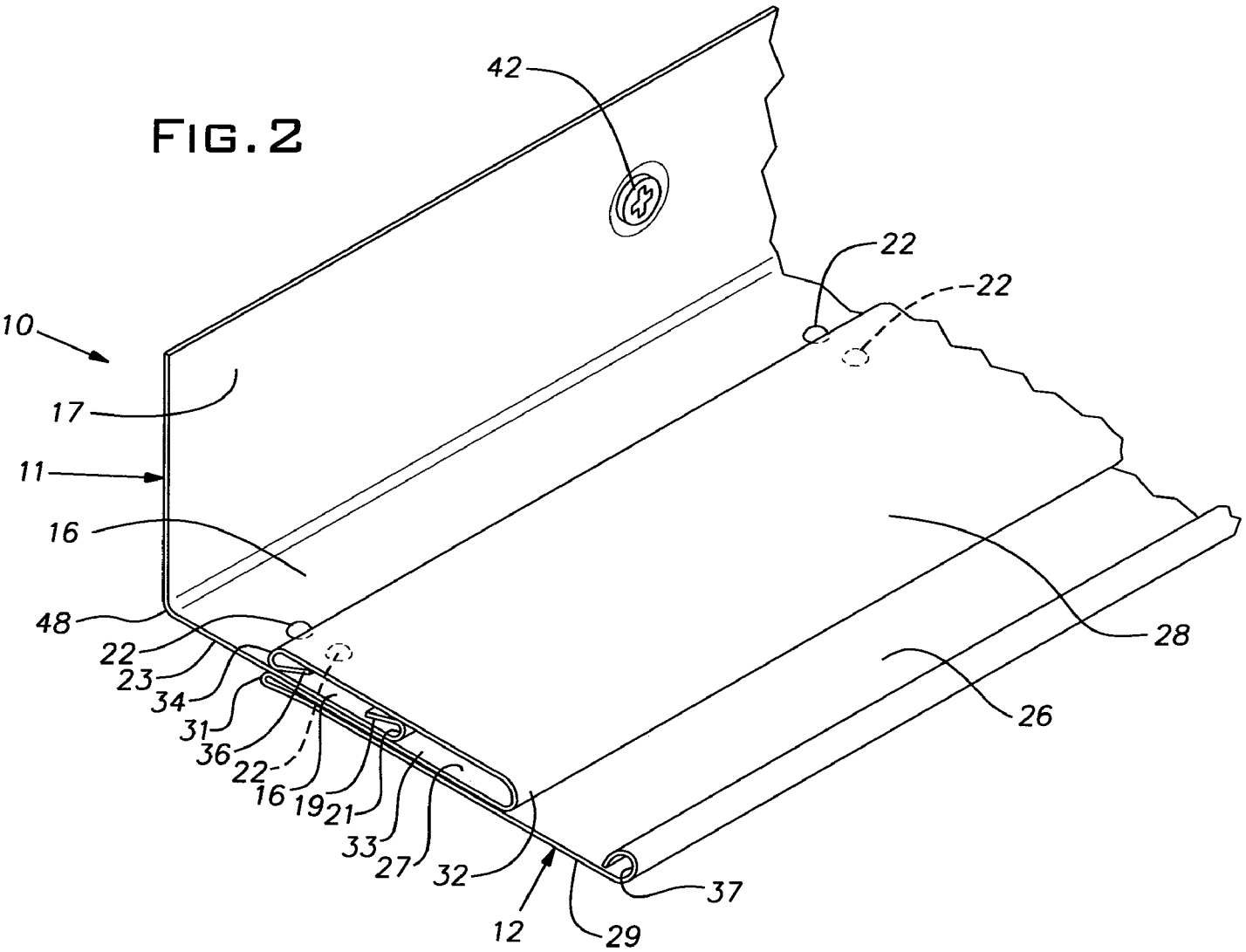
FIG. 2 is an enlarged isometric fragmentary view of the wall angle of the invention.

A wall angle 10 constructed in accordance with the invention is a two-part assembly comprising a base angle 11 and an extension strip 12. The wall angle 10 is especially suited for seismic applications by virtue of having a relatively wide horizontal side indicated generally at 13. Both the base angle and extension strip components 11, 12 are unitary or one-piece elements preferably made of roll-formed sheet metal, typically steel or, less commonly, aluminum. The metal strips forming these components 11, 12 can be coated, plated or otherwise treated to impart corrosion resistance and whether or not so treated, are usually finish painted for improved appearance. Such treatments and painting are ordinarily done before roll forming of the components 11, 12.

The base angle 11 and extension strip 12 are provided in standard lengths of, for example, 10 foot or 12 foot or metric equivalent. The base angle 11 and extension strip 12 have their profiles drawn to scale in the figures for one example of a working assembly. The base angle 11 can be formed of 0.020" CRCQ steel, pre-painted, and the extension strip can be formed of 0.015" CRCQ steel, pre-painted.

The base angle 11 has horizontal and vertical legs 16, 17, respectively, of equal length slightly less than 1-⅛" extending from a common corner 18. The extension strip 12 has a face width of 1-½". The horizontal leg 16 of the base angle 11 has a hem 19 along a distal edge 21 formed by reversed bending of a small width of the sheet metal stock from which it is made. At mid-width, the horizontal leg 16 of the base angle 11 is made with pairs of small formations or protrusions 22 that are reflected as dimples on its underside or face side 23. The pairs of protrusions 22 are arrayed in a regular spacing along the length of the base angle leg 16, for example, on 3" centers. The vertical leg 17 can be planar or flat and devoid of a hem or protrusions.

The extension strip 12 is folded on itself by conventional roll forming techniques into a form that can be characterized as a flattened Z-strip having three principle layers 26-28. A lower layer 26 which provides a visible finish face on its underside 29 in the illustrated arrangement is wider than the other layers 27, 28 and can have a width of about 1-½".

The intermediate layer 27 is folded or bent flat or essentially flat against the upper side of the lower layer 26 from a fold line or edge 31 shared with the lower layer 26. The intermediate layer 27 is folded at an edge or web 32 shared with the upper layer 28. The edge or fold line 32 is spaced about slightly more than ⅔ of the width of the lower or face layer 26, i.e. slightly more than 1" from the edge 31. The fold at the edge 32 is slightly open so that it forms a web and the upper and intermediate layers 28, 27 form a space or slot 33 that is capable of slidably receiving the hem 19 of the horizontal leg 16 of the base angle 11. Ideally, the width of the space 33 is at least as large as the width of the horizontal leg 16 of the base angle 11. A free edge 34 of the upper layer 28 overlying the fold 31 is in-turned to form a narrow relatively flat hem 36. The face forming lower layer 26 at an edge opposite the fold 31 has an integrally formed round hollow bead 37 extending above the plane of this layer. The round bead 37 is sized so that it is tangent at its upper extremity to the plane of the upper layer 28.

FIG. 1 illustrates a typical example of an installation of the seismic wall angle 10 of the invention. The base angle 11 is secured to a wall 41 by screws or other fasteners 42 preferably anchored into vertical studs 43. The base angle 11 is installed over sheets of drywall 44 forming the wall 41. A non-tapered joint 46 is usually characterized by a local non-flat area in reference to the planar or flat main areas of the wall 41. Other wall constructions and conditions likewise give rise to similar deviations from a truly flat wall surface.

When one leg of a normally straight shaft-like angle, such as a conventional wall angle, is forced to bend out of its plane, internal stresses in the angle cause the other leg to buckle out of its plane. Ordinarily in building construction a wall angle that is, say, ¾"×¾" up to about 1"×1", the degree to which a horizontal leg buckles out of its plane when the vertical leg is bent over a non-flat wall area of ordinary deviation is visually acceptable or can be made acceptable by manually locally bending the horizontal leg more or less back into its plane. Where the horizontal leg of a wall angle is relatively wide, such as for seismic applications, ordinary deviations in the flatness of a wall can cause totally unacceptable buckling of the horizontal leg which, from a practical standpoint, may be non-correctable.

The invention capitalizes on the fact that a relatively short horizontal leg wall angle normally does not buckle to an objectionable degree when installed on a typical wall with ordinary deviations from a flat plane. More specifically, the invention solves the buckling problem by effectively isolating the primary internal bending stresses imposed on the base angle horizontal leg 16 from the extension strip 12. By isolating the stresses within the base angle 11, there are no direct internal stresses set up in the extension strip 12 which would cause it to buckle up or down. Moreover, the extension strip actually tends to restrain some of the buckling of the base angle horizontal leg 16 to the extent that some minor degree of such buckling would potentially be developed. This restraint occurs because, as shown, the base angle horizontal leg 16 is captured between the lower and middle layers 26, 27 of the extension strip 12. Normally, the bulbous hem 36 of the upper layer 28 of the extension strip 12 is received and detented between adjacent pairs of the projections or protrusions 22 in the base angle horizontal leg 16. The extension strip 12 is biased or tends to remain indexed in the position where the hem 36 is so disposed by virtue of the natural spring-like action of the extension strip layers 26-28 to maintain their roll formed configuration. The configuration of the base angle 11 and extension strip 12 is such that a friction grip of the extension strip on the base angle horizontal leg 16 exists when these parts are assembled. This grip is established, on the top face of the base angle leg, between the hem 36 and base angle leg 16 and/or between the upper layer 28 and the hem 19 and, on the bottom face of the base angle leg, between the intermediate layer 27 and the base angle leg.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A wide wall angle useful in locations of seismic activity to support ceiling tile and grid tees of a suspended ceiling comprising an assembly of an elongated base angle and an elongated extension strip, the base angle having generally perpendicular legs integral with one another and intersecting at a longitudinally extending corner, one leg being adapted to be fixed against a wall with the corner down, and the other adapted to project horizontally from the wall, the extension strip having a face width greater than the width of the horizontal leg, the extension strip having a multiple layer construction, two layers of the extension strip being held together in close parallel relation by an intermediate web integral with the layers and extending lengthwise parallel to the corner, at least portions of the two layers being arranged to frictionally engage at least a part of the horizontal leg of the base angle spaced from the corner such that the strip can be assembled on and frictionally retained on the horizontal leg of the base angle, the horizontal leg of the base angle being disposed between the two layers of the extension strip.

2. A wide wall angle as set forth in claim 1, wherein said extension strip is formed of sheet metal folded on itself into three layers.

3. A wide wall angle as set forth in claim 2, wherein a lower layer of said layers is wider than the remainder of said layers.

4. A wide wall angle as set forth in claim 2, wherein two layers of said extension strip form a slot for receiving the horizontal leg of said base angle.

5. A wide wall angle as set forth in claim 4, wherein the width of the slot is less than a face width of the extension strip.

6. A wide wall angle as set forth in claim 4, wherein the width of the slot is at least as wide as the width of the horizontal leg of the base angle.

7. A wide wall angle as set forth in claim 1, wherein two layers of said extension strip form a slot, an upper layer forming said slot includes a hem on a side adjacent a second intermediate layer, and a third layer forms a face of the extension strip.

8. A wide wall angle as set forth in claim 7, wherein the width of said slot is less than the width of said face.

9. A wide wall angle as set forth in claim 8, wherein the lower layer of said extension strip has a hem on a free edge, said free edge hem having a vertical dimension approximating the combined thickness of said three layers, including the slot formed by said intermediate and upper layers.

10. A wide wall angle as set forth in claim 1, wherein said horizontal leg of said base angle has detent formations for engagement with a bulbous area of a layer of said extension strip.

* * * * *